US006931805B2

(12) United States Patent
Gregory et al.

(10) Patent No.: US 6,931,805 B2
(45) Date of Patent: Aug. 23, 2005

(54) POST CONSTRUCTION ALIGNMENT AND ANCHORING SYSTEM AND METHOD FOR BUILDINGS

(75) Inventors: Steven D. Gregory, Plano, TX (US); Christopher Wayne Bacon, Ada, OK (US); Robert Kent Pharr, Stonewall, OK (US)

(73) Assignee: Gregory Enterprises, Inc., Garland, TX (US)

( * ) Notice: Subject to any disclaimer, the term of this patent is extended or adjusted under 35 U.S.C. 154(b) by 0 days.

(21) Appl. No.: 10/370,848

(22) Filed: Feb. 20, 2003

(65) Prior Publication Data

US 2004/0163341 A1 Aug. 26, 2004

(51) Int. Cl.[7] ..... E02D 27/00
(52) U.S. Cl. ..... 52/296; 52/146
(58) Field of Search ..... 52/146, 156, 157, 52/155, 519, 296

(56) References Cited

U.S. PATENT DOCUMENTS

| | | | | | |
|---|---|---|---|---|---|
| 876,248 | A | * | 1/1908 | Tiedeman | 52/146 |
| 931,495 | A | * | 8/1909 | Saunders | 256/48 |
| 2,300,375 | A | * | 10/1942 | Turner | 52/150 |
| 3,491,497 | A | * | 1/1970 | Bauer | 52/166 |
| 3,832,861 | A | * | 9/1974 | Jahnke et al. | 52/127.5 |
| 3,973,409 | A | * | 8/1976 | Asayama | 405/259.5 |
| 4,074,481 | A | * | 2/1978 | Lang et al. | 52/169.8 |
| 4,634,319 | A | | 1/1987 | May | |
| 4,673,315 | A | | 6/1987 | Shaw et al. | |
| 4,694,625 | A | | 9/1987 | Gregory | |
| 4,695,203 | A | | 9/1987 | Gregory | |
| 4,754,588 | A | | 7/1988 | Gregory | |
| 4,765,777 | A | | 8/1988 | Gregory | |
| 4,878,781 | A | | 11/1989 | Gregory et al. | |
| 4,911,580 | A | | 3/1990 | Gregory et al. | |
| 5,722,798 | A | | 3/1998 | Gregory | |
| 5,927,905 | A | * | 7/1999 | van Halteren | 405/252.1 |
| 5,951,206 | A | | 9/1999 | Gregory | |
| 6,247,273 | B1 | * | 6/2001 | Nickel | 52/127.2 |
| 6,256,940 | B1 | * | 7/2001 | MacKarvich | 52/126.6 |
| 6,514,012 | B2 | | 2/2003 | Gregory et al. | |

* cited by examiner

*Primary Examiner*—Peter M. Cuomo
*Assistant Examiner*—Stephen Vu
(74) *Attorney, Agent, or Firm*—Haynes and Boone, LLP

(57) ABSTRACT

A method for moving a wall from a first position to a second position and anchoring the wall in the second position, according to which a portion of an elongated assembly is placed through an opening in the wall. An auger is provided on one end portion of the assembly and torque is applied to the assembly to cause the auger to penetrate the ground, and a nut is advanced along the assembly to engage the wall and force the wall from the first position to the second position.

26 Claims, 4 Drawing Sheets

10
23
22
14
E
28b
28a
14a
30b
24
18
26
26a
30a
12
26b
16
20

POST CONSTRUCTION ALIGNMENT AND ANCHORING SYSTEM AND METHOD FOR BUILDINGS

BACKGROUND

This invention relates to a post construction alignment and anchoring system and method for a building.

After a building has been constructed, vertical walls often deviate from a true vertical alignment in time, due to changes in soil conditions, age, poor construction, etc. This problem is especially acute in connection with basements, since any deviation of a load-supporting basement wall can cause significant problems in connection with the remainder of the building supported by the wall. Many techniques for correcting this involve major reconstruction and an expenditure of significant time, effort and expense.

Therefore, what is needed is a post construction alignment and anchoring system and method according to which a deviated wall can be moved back into a true vertical alignment and anchored in the latter position at a relatively low expenditure of labor and expense.

DETAILED DESCRIPTION

Figure 1:
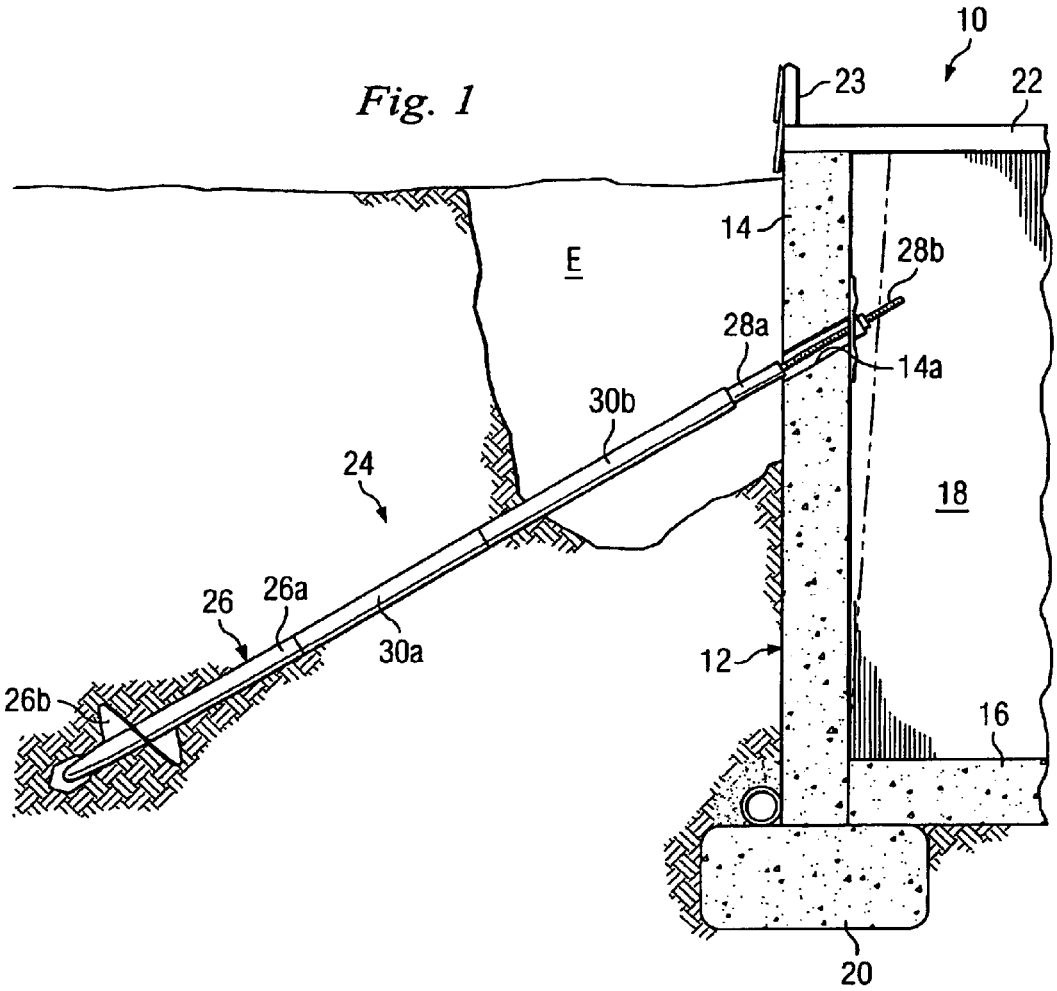
FIG. 1 is a partial sectional view of a building employing an anchoring system according to an embodiment of the present invention.
Figure 2:
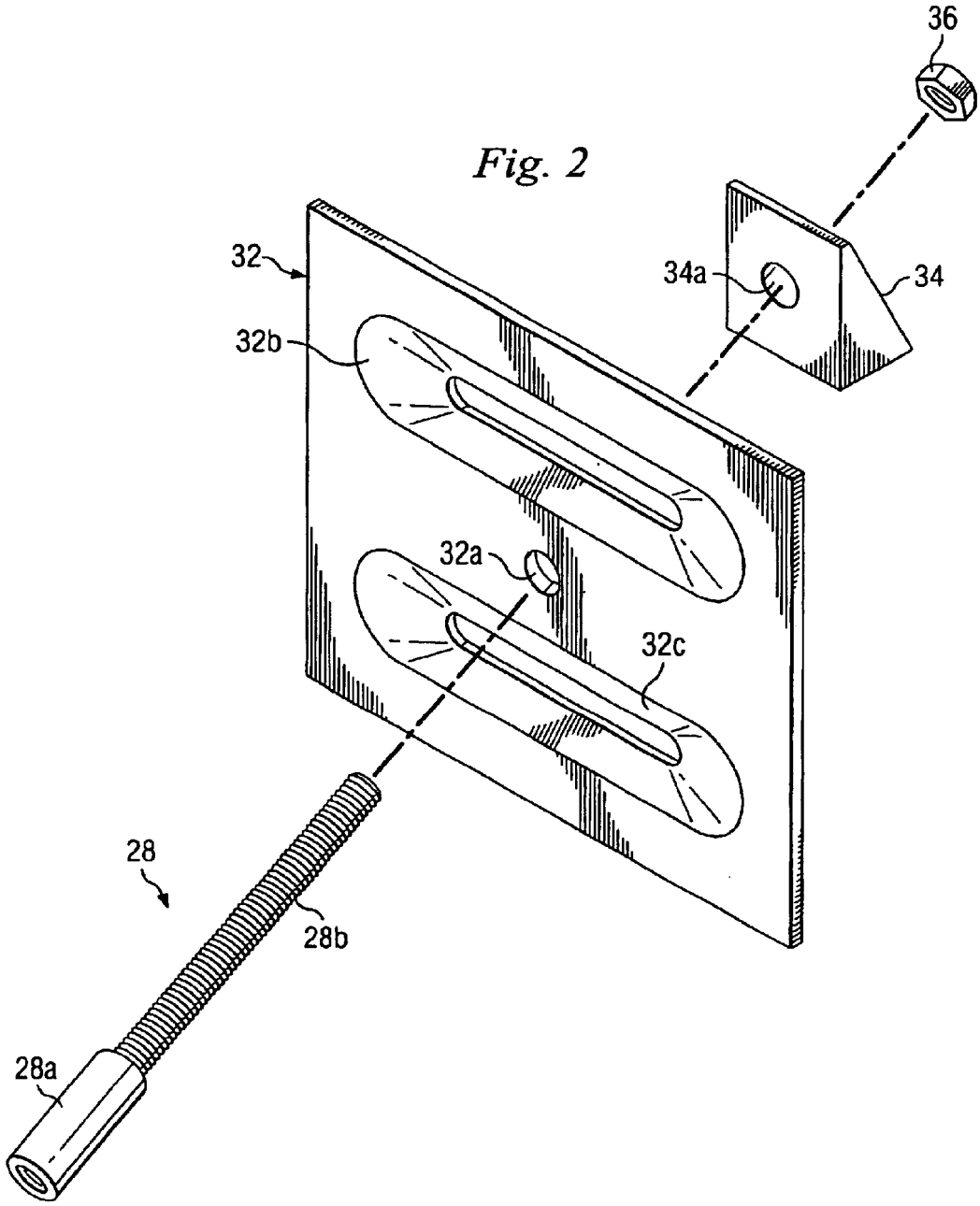
FIG. 2 is an enlarged isometric view depicting several components of the anchoring system of FIG. 1.

Referring specifically to FIGS. 1 and 2 of the drawings, the reference numeral 10 refers, in general, to a building having an underground basement 12 formed, in part, by a vertical front wall 14, a floor, or horizontal, wall 16, and a vertical side wall 18. The front wall 14, and a portion of the floor 16 rest on a horizontal footer 20. Although a rear wall and another side wall are not shown, in a normal installation they also would be provided. The footer 20 extends underneath all of the vertical walls, including the front wall 12 and the side wall 18. The walls 14, and 18, the floor 16, and the footer 20 all are formed of concrete.

It is understood that the remaining portion of the building 10 extends above the basement 12. This remaining, above-ground, portion of the building 10 is not shown in FIG. 2 with the exception of a portion of a floor 22 and a front wall 23, it being understood that the building would also include a rear wall, and two side walls. In most installations of this type, the exterior walls, including the wall 23, of the above-ground portion of the building 10 would normally be aligned with, and supported by, the front wall 14, the side wall 16, and the aforementioned rear wall and other side wall of the basement 12, respectively.

The system of the embodiment of FIG. 1 is designed to realign any vertical wall of the basement 12 that has deviated, or tilted, from a true vertical position. For the purpose of example, it will be assumed that the front wall 14 of the basement 12 has deviated or tilted inwardly as shown by the phantom lines in FIG. 1, which depict the inner surface of the wall 14. In this case the system of the present invention functions to realign the wall 14 back to a true vertical position, and anchor the wall in the latter position.

To this end, the system of the embodiment of FIG. 1 includes an assembly of cylindrical members connected in an end-to-end relationship and referred to in general by the reference numeral 24. The assembly 24 includes an auger section 26, a connecting section 28, and two intermediate sections 30*a* and 30*b*. The auger section 26 includes a tubular member 26*a* and a helical auger, or earth screw, 26*b* mounted at one end of the tubular member. Both of the intermediate sections 30*a* and 30*b* are in the form of tubular members, and the connecting section 28 includes a hollow tubular member 28*a* and an externally threaded shaft 28*b* extending from one end of the latter member. The corresponding ends of the intermediate section 30*a* and the auger section 26; the corresponding ends of the intermediate sections 30*a* and 30*b*; and the corresponding ends of the intermediate section 30*b* and the connecting section 28 are connected together in a manner to be described. The assembly 24 extends through a opening 14*a* extending through the wall 14*a* at an angle to the plane of the wall, with the auger 26 penetrating the ground outside the wall 14 and the threaded shaft 28*b* extending inside the wall in the interior of the basement 12.

Referring to FIG. 2, a plate 32, having a central opening 32*a* formed therethrough and two horizontally extending raised portions 32*b* and 32*c*, is provided for connecting the assembly 24 to the wall 14 (FIG. 1) in a manner to be described. A tapered anchor washer 34 having a central opening 34*a* formed therethrough is provided for engaging the plate 36, along with a nut 36 sized to engage the threaded shaft 28*b* of the section 28.

Figure 3:
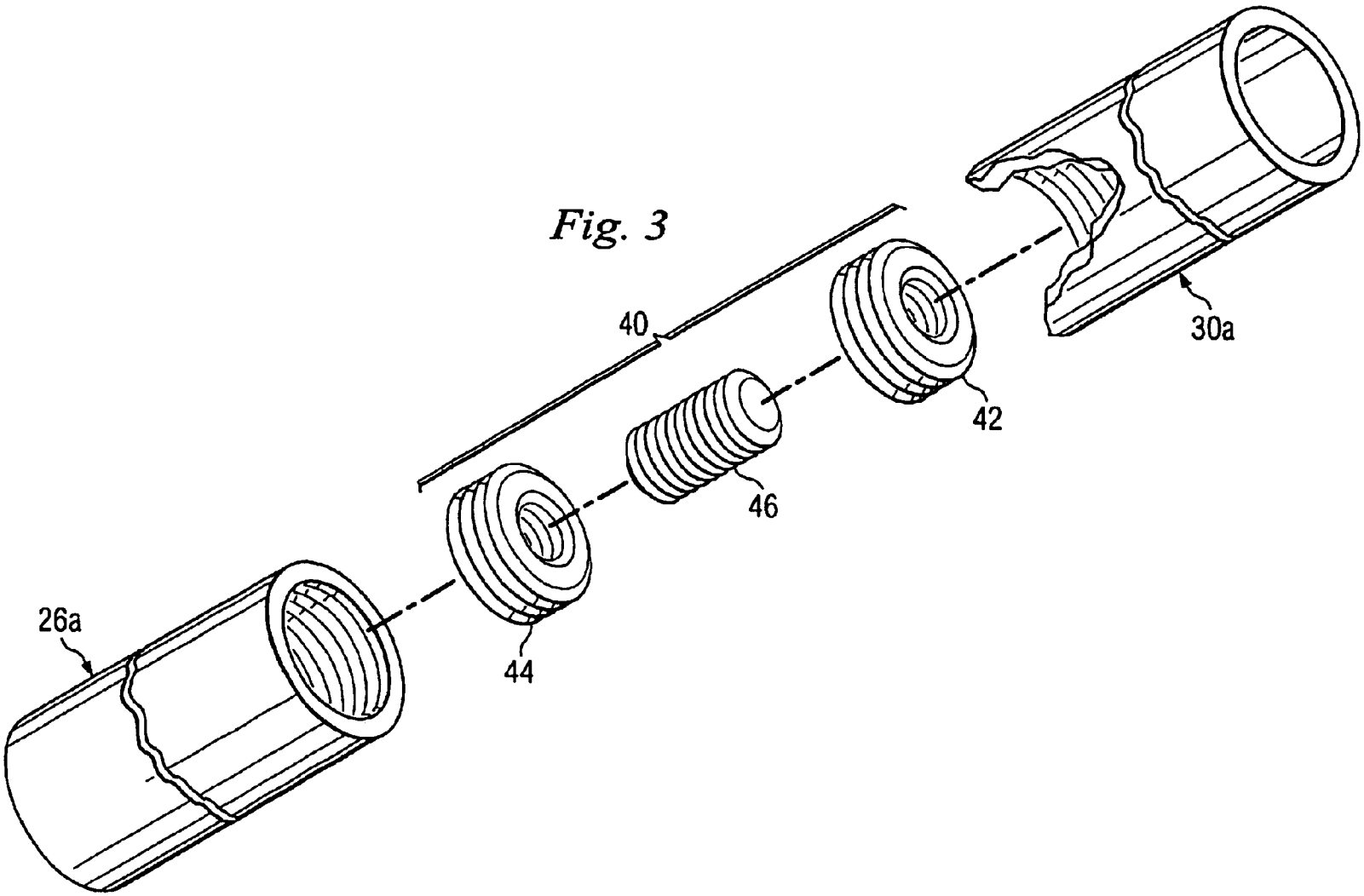
FIGS. 3 and 4 are enlarged isometric views depicting two alternate assemblies for connecting components of the anchoring system of FIG. 1.

Referring to FIG. 3, an apparatus for connecting the corresponding ends of the intermediate section 30*a* and the tubular member 26*a* of the auger section 26 is referred to, in general, by the reference numeral 40. The apparatus includes two ring-shaped fasteners 42 and 44 each of which are both internally threaded and externally threaded. The corresponding end portions of the intermediate section 30*a* and the tubular member 26*a* are internally threaded so as to receive the fasteners 42 and 44, respectively in a threaded engagement. An externally threaded rod 46 is provided which is sized to threadedly engage the latter threaded surfaces of each of the fasteners 42 and 44.

To connect the intermediate section 30*a* to the tubular member 26*a*, the fasteners 42 and 44 are threadedly engaged in the corresponding end portions of the intermediate section 30*a* and the tubular member 26*a*, respectively, and thus advance into the sections until the respective faces of the fasteners at least extend flush with the respective ends of the sections. Then the respective end portions of the rod 46 are threadedly engaged in the fasteners 42 and 44. This can be done in sequence by initially inserting one end of the rod 56 in one of the fasteners 42 or 44 and rotating the rod relative to the fastener, or vice versa, to advance the rod into the fastener, and then inserting the other end of the rod in the other fastener and rotating the rod relatively to the latter fastener, or vice versa. The amount of rotation is such that each end portion of the rod 46 extends through the fasteners 42 and 44, respectively, for an axial length sufficient to permit the corresponding ends of the latter sections to abut in the assembled condition shown in FIG. 1.

It is understood that the corresponding ends of the intermediate sections 30*a* and 30*b*, as well as the corresponding ends of the intermediate section 30*b*, and the tubular member 28*a* of the connecting section 28, are connected together in the same manner.

In operation, and assuming the front wall 14 has tilted, or deviated from a true vertical position, to a position shown by the phantom line in FIG. 1, an excavation area E is formed in the ground next to the wall 14 and the above-mentioned angled opening 14*a* is drilled, or otherwise formed, through the wall 14. The section 30*a* is passed through the opening and the auger section 26 is connected to the section 30*a* in the excavation area E in the manner described above. A torque applying device (not shown) is connected to the section 30*a* inside the basement 12 and activated to apply torque to the connected sections 30*a* and 26 so that the auger 26*b* penetrates the ground in response to the rotational movement. When the trailing end of the section 30*a* in the basement 12 approaches the opening 14*a*, the section 30*b* is connected to the section 30*a* inside the basement in the manner described above and torque applied to the section 30*b*. This continues with one or more additional intermediate sections (not shown) identical to the sections 30*a* and 30*b* until the auger 26 encounters sufficient resistance which can be determined in a conventional manner. The last connected intermediate section is then disconnected from the previous intermediate section, which, in the example shown, is section 30*b*, and the section 28 is connected to the section 30*b* so that the section 28 extends through the opening 14*a*. The assembly 24 thus formed extends at an angle to the wall 14 with the magnitude of the angle being determined by the angle of the opening 14*a*.

The end of the shaft 28*a* is then placed through the opening 32*a* of the plate 32 and through the opening 34*a* of the washer 34 and the nut 36 is threadedly engaged with the latter end. Torque is then applied to the nut 36 in any known manner while the auger 26 anchors the other end portion of the assembly 24 in the ground. This forces the plate 32 against the inner surface of the wall 14 and then forces the upper portion of the wall in a direction from right-to-left, as viewed in FIG. 1, so that it pivots, or tilts, about its lower end. This tilting movement continues until the wall reaches a true vertical alignment as shown by the solid lines in FIG. 1. During this application of torque to the nut 36, the tapered washer 34 enables the nut to extend substantially perpendicular to the axis of the shaft 28*b* so that the force is directed along the axis of the latter shaft.

In this connected position, the system 24 serves as an anchoring system to maintain the wall 14 in a true vertical alignment. It is understood that additional systems 24 can be placed, in a spaced relation, along the wall 14 and work together in unison to return the wall to a true vertical position and anchor the wall, in the same manner. The excavation E would then be filled in to complete the installation.

It is thus seen that the system 24 of the present invention enables a wall to be returned to a true vertical position and anchored in the latter position, at a relatively low expenditure of labor and expense.

Figure 4:
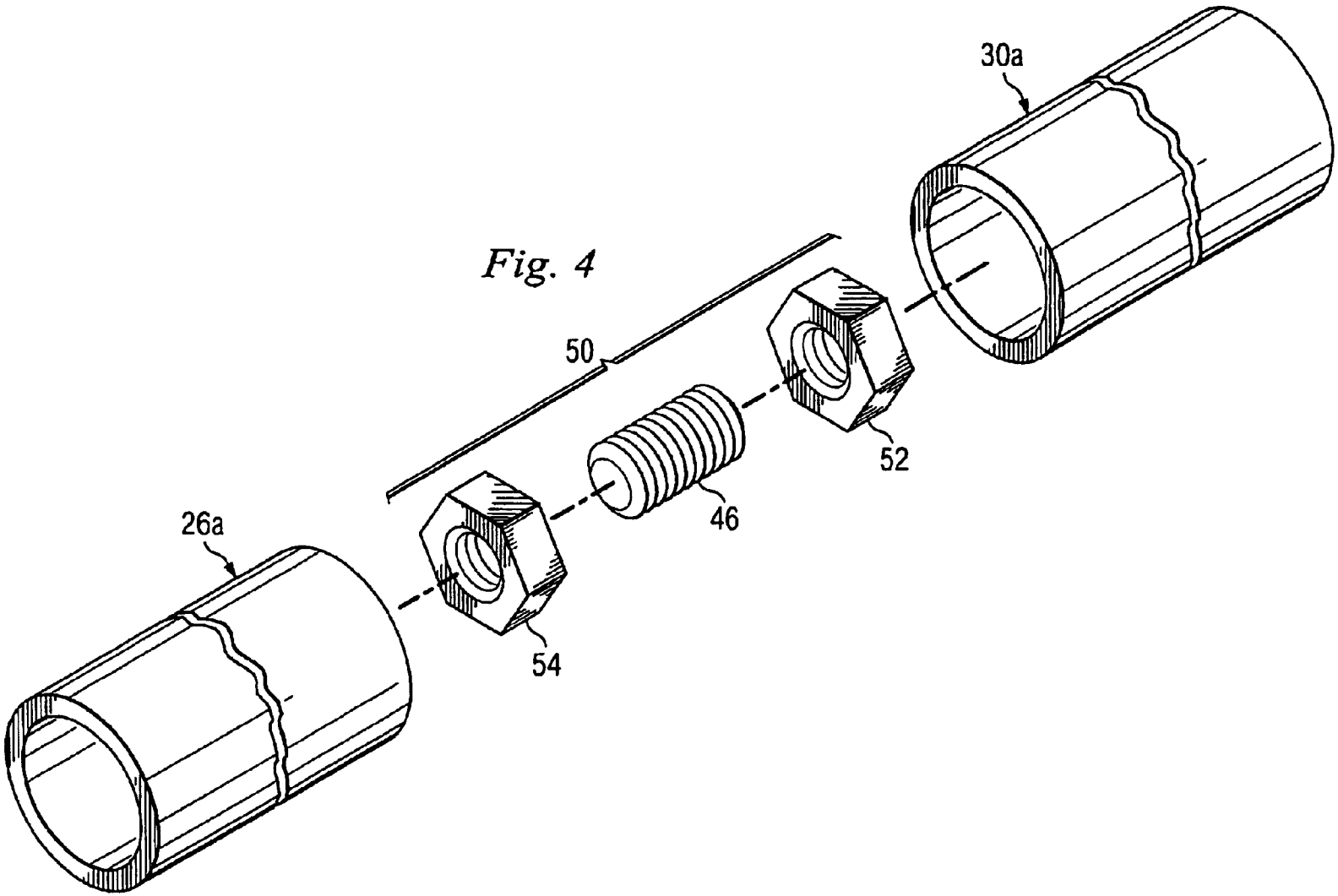

A connecting apparatus according to another embodiment is shown, in general, by the reference numeral 50 in FIG. 4 and is also adapted to connect the corresponding ends of the intermediate section 30*a* and the tubular member 26*a* of the auger section 26. The system 50 comprises two fasteners 52 and 54, which are sized to extend in the corresponding end portions of the section 30*a* and the tubular member 26*a*, respectively. The outer surface of each fastener 52 and 54 is hexagonal in shape, thus forming six planer surfaces and six angles, with the apexes of the angles between adjacent surfaces extending relative to the corresponding inner surfaces of the section 30*a* and the tubular member 26*a* respectively, with minimal clearance.

The fasteners 52 and 54 are secured in the end portions of the section 30*a* and the tubular member 26*a* with the respective outer faces of the fasteners at least extending flush with the corresponding ends of the sections. This can be done in any conventional manner such as by welding the outer planer surfaces of the fasteners 52 and 54 to the corresponding inner surfaces of the section 30*a* and the tubular member 26*a*. Each fastener 52 and 54 has an internally threaded bore, and an externally threaded rod 56, identical to the rod 46 of the previous embodiment, is provided which is sized to threadedly engage the bores of the fasteners. The section 30*a* and the tubular member 26*a* are thus connected in an end-to-end abutting relationship.

It is understood that the corresponding ends of the intermediate sections 30*a* and 30*b*, as well as the corresponding ends of the intermediate section 30*b* and the tubular member 28*a* of the connecting section 28 can be connected together by the apparatus 50 in the same manner.

Variations

The above embodiments are not limited to two intermediate sections 30*a* and 30*b*, but rather, the number of intermediate sections can be varied depending on the depth in the ground that the auger section 26*a* has to penetrate in order to attain adequate support. Also, the wall that is returned to vertical and anchored in the above manner does not necessarily have to be below ground.

The fasteners 42, 44, 52 and 54 can be fastened into the interior of the tubular members 26*a* and 28*a* and the sections 30*a* and 30*b* by other techniques utilizing other components, such as by adhesives, bolts, pins, clips, etc.

The outer surfaces of the fasteners 42, 44, 52 and 54 do not have to extend flush with the corresponding ends of the tubular members 26*a* and 28*a* and the sections 30*a* and 30*b* but rather can extend in the sections a predetermined distance.

Since other modifications, changes, and substitutions are intended in the foregoing disclosure, it is appropriate that the appended claims be construed broadly and in a manner consistent with the scope of the invention.

What is claimed is:

1. An assembly for moving a structure, the assembly comprising:

a first section for extending outside the structure and having an auger at one end portion thereof that is adapted to penetrate the ground outside the structure;

a second section having at least a portion for extending through an opening in the structure and one end portion for extending inside the structure;

a third section having one end portion in a threaded connection with the other end portion of the first section and another end portion in a threaded connection with the other end portion of the second section; and a threaded member in threaded engagement with the one end portion of the second section so that rotation of the threaded member moves the structure.

2. The assembly of claim 1 wherein the auger anchors the assembly in the ground while the threaded member applies a force to the structure.

3. The assembly of claim 1 wherein torque is applied to the third section from inside the structure to cause the auger to penetrate the ground outside the structure.

4. The assembly of claim 3 wherein the second section is connected to the third section after the auger penetrates the ground.

5. The assembly of claim 1 wherein the third section can be connected to the first section and torque applied to the third section, and therefore the first section, before the second section is connected to the third section.

6. The assembly of claim 5 wherein the torque can be applied to the third section from inside the structure.

7. The assembly of claim 1 wherein the structure is moved from a position in which it extends at an angle relative to a vertical axis and to a position in which it extends substantially vertically.

8. The assembly of claim 1 wherein the opening and the longitudinal axes of the sections extend at an angle to a horizontal axis.

9. The assembly of claim 1 further comprising means for establishing the threaded connection between the one end portion of the third section and the other end portion of the first section, the means comprising a first connecting member secured in the one end portion of the third section, a second connecting member secured in the other end portion of the first section, and a third connecting member connecting the first and second connecting members, and therefore the first and third sections in an abutting, end-to-end relationship.

10. The system of claim 9 wherein the respective outer ends of the first and second connection members extends substantially flush with the ends of the corresponding sections.

11. The assembly of claim 9 wherein the respective end portions of the first and third sections are internally threaded and wherein the first and second connecting members have external threads that threadedly engage the internal threads of the corresponding sections to secure the first and second connecting members to their corresponding sections.

12. The assembly of claim 11 wherein the first and second connecting members are internally threaded and wherein the third connecting member is externally threaded and threaded engages the first and second connecting members.

13. The assembly of claim 9 wherein the first and second connecting members are welded in the corresponding sections.

14. The assembly of claim 13 wherein the respective end portions of the first and third sections internally threaded and wherein the first and second connecting members have external threads that threadedly engage the internal threads of the corresponding sections to secure the first and second connecting members to their corresponding sections.

15. The assembly of claim 13 wherein the first and second connecting members are internally threaded and wherein the third connecting member is externally threaded and threaded engages the first and second connecting members.

16. The system of claim 13 wherein the outer surface of each of the first and second connecting members has a plurality of planar surfaces with a angle extending between adjacent planer surfaces, the apexes of the angles extending in their corresponding piling sections with minimal clearance.

17. The system of claim 16 wherein the weldments extend between the planer surfaces of the connecting members and the corresponding inner surfaces of the corresponding piling section and between adjacent apexes.

18. The assembly of claim 1 further comprising means for establishing the threaded connection between the other end portion of the third section and the other end portion of the second section, the means comprising a first connecting member secured in the other end portion of the third section, a second connecting member secured in the other end portion of the second section, and a third connecting member connecting the second and second connecting members, and therefore the second and third sections in an abutting, end-to-end relationship.

19. The system of claim 18 wherein the respective outer ends of the first and second connection members extends substantially flush with the ends of the corresponding sections.

20. The assembly of claim 18 wherein the respective end portions of the second third sections are internally threaded and wherein the first and second connecting members have external threads that threadedly engage the internal threads of the corresponding sections to secure the second and second connecting members to their corresponding sections.

21. The assembly of claim 20 wherein the first and second connecting members are internally threaded and wherein the third connecting member is externally threaded and threaded engages the first and second connecting members.

22. The assembly of claim 18 wherein the first and second connecting members are welded in the corresponding sections.

23. The assembly of claim 22 wherein the first and second connecting members are internally threaded and wherein the third connecting member is externally threaded and threaded engages the first and second connecting members.

24. The system of claim 22 wherein the outer surface of each of the first and second connecting members has a plurality of planar surfaces with a angle extending between adjacent planer surfaces, the apexes of the angles extending in their corresponding piling sections with minimal clearance.

25. The system of claim 24 wherein the weldments extend between the planer surfaces of the connecting members and the corresponding inner surfaces of the corresponding piling section and between adjacent apexes.

26. The assembly of claim 22 wherein the respective end portions of the second and third sections internally threaded and wherein the first and second connecting members have external threads that threadedly engage the internal threads of the corresponding sections to secure the first and second connecting members to their corresponding sections.

* * * * *